US009328579B2

(12) United States Patent
Wilson

(10) Patent No.: US 9,328,579 B2
(45) Date of Patent: May 3, 2016

(54) MULTI-CYCLE CIRCULATING TOOL

(75) Inventor: Timothy L. Wilson, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 907 days.

(21) Appl. No.: 13/549,247

(22) Filed: Jul. 13, 2012

(65) Prior Publication Data

US 2014/0014360 A1 Jan. 16, 2014

(51) Int. Cl.
*E21B 21/10* (2006.01)
*E21B 23/00* (2006.01)
*E21B 34/00* (2006.01)

(52) U.S. Cl.
CPC ..... *E21B 23/006* (2013.01); *E21B 21/103* (2013.01); *E21B 2034/007* (2013.01)

(58) Field of Classification Search
CPC ..... E21B 21/10; E21B 34/14
See application file for complete search history.

(56) References Cited

U.S. PATENT DOCUMENTS

| | | | | |
|---|---|---|---|---|
| 4,113,012 | A | 9/1978 | Evans et al. | |
| 4,373,582 | A | 2/1983 | Bednar et al. | |
| 4,406,335 | A | 9/1983 | Koot | |
| 4,557,333 | A | 12/1985 | Beck | |
| 4,574,894 | A | 3/1986 | Jadwin | |
| 4,633,958 | A | 1/1987 | Mouton | |
| 4,657,082 | A | 4/1987 | Ringgenberg | |
| 4,889,199 | A | 12/1989 | Lee | |
| 5,146,992 | A | 9/1992 | Baugh | |
| 5,335,731 | A * | 8/1994 | Ringgenberg et al. | 166/336 |
| 5,499,687 | A | 3/1996 | Lee | |
| 5,791,414 | A | 8/1998 | Skinner et al. | |
| 5,890,540 | A | 4/1999 | Pia et al. | |
| 5,901,796 | A | 5/1999 | McDonald | |
| 5,979,572 | A | 11/1999 | Boyd et al. | |
| 6,065,541 | A | 5/2000 | Allen | |
| 6,095,249 | A | 8/2000 | McGarian et al. | |
| 6,102,060 | A | 8/2000 | Howlett et al. | |
| 6,152,228 | A | 11/2000 | Carmichael | |
| 6,173,795 | B1 | 1/2001 | McGarian et al. | |
| 6,189,618 | B1 | 2/2001 | Beeman et al. | |
| 6,220,357 | B1 | 4/2001 | Carmichael et al. | |

(Continued)

FOREIGN PATENT DOCUMENTS

WO 02075104 A1 9/2002

OTHER PUBLICATIONS

PCT International Search Report and Written Opinion for Application PCT/US2013/049982, dated Jul. 20, 2014.

(Continued)

*Primary Examiner* — William P Neuder
(74) *Attorney, Agent, or Firm* — Patterson & Sheridan, LLP

(57) ABSTRACT

A method and apparatus for circulating fluid in a wellbore includes a bottom sub having a bottom sub port and a mandrel, wherein the mandrel substantially forms an inner bore of the circulating tool and includes a mandrel port. The circulating tool may also include an activation piston that is movable in a first direction and a port piston movable in a second direction when the activation piston moves in the first direction. The circulating tool may further include an inner sleeve coupled to the port piston and movable with the port piston, the inner sleeve having an inner sleeve port in selective communication with the mandrel port. When the inner sleeve port is in communication with the mandrel port at least partially, circulating fluid is allowed to flow through the bottom sub port to the wellbore.

25 Claims, 7 Drawing Sheets

(56) References Cited

U.S. PATENT DOCUMENTS

| | | | |
|---|---|---|---|
| 6,253,861 | B1 | 7/2001 | Carmichael et al. |
| 6,279,657 | B1 | 8/2001 | Carmichael et al. |
| 6,289,999 | B1 | 9/2001 | Dewey et al. |
| 6,378,612 | B1 | 4/2002 | Churchill |
| 6,543,532 | B2 | 4/2003 | Estep et al. |
| 6,725,937 | B1 | 4/2004 | McHardy |
| 6,732,793 | B1 | 5/2004 | Lee |
| 6,820,697 | B1 | 11/2004 | Churchill |
| 6,866,100 | B2 | 3/2005 | Gudmestad et al. |
| 6,920,930 | B2 | 7/2005 | Allamon et al. |
| 7,055,605 | B2 | 6/2006 | Howlett et al. |
| 7,168,493 | B2 | 1/2007 | Eddison |
| 7,281,584 | B2 | 10/2007 | McGarian et al. |
| 7,299,880 | B2 | 11/2007 | Logiudice et al. |
| 7,318,478 | B2 | 1/2008 | Royer |
| 7,322,419 | B2 | 1/2008 | Carmichael |
| 7,337,847 | B2 | 3/2008 | McGarian et al. |
| 7,347,288 | B2 | 3/2008 | Lee |
| 7,350,598 | B2 | 4/2008 | Booth |
| 7,357,198 | B2 | 4/2008 | McGarian et al. |
| 7,383,881 | B2 | 6/2008 | Telfer |
| 7,416,029 | B2 | 8/2008 | Telfer et al. |
| 7,441,607 | B2 | 10/2008 | Telfer |
| 7,503,398 | B2 | 3/2009 | LoGiudice et al. |
| 7,520,336 | B2 | 4/2009 | Mondelli et al. |
| 7,530,400 | B2 | 5/2009 | Telfer |
| 7,628,213 | B2 | 12/2009 | Telfer |
| 7,661,478 | B2 | 2/2010 | Palmer et al. |
| 7,673,708 | B2 | 3/2010 | Lee |
| 7,681,650 | B2 | 3/2010 | Telfer et al. |
| 7,766,084 | B2 | 8/2010 | Churchill |
| 7,766,086 | B2 | 8/2010 | Mondelli et al. |
| 2003/0066652 | A1 | 4/2003 | Stegemeier et al. |
| 2004/0163809 | A1 | 8/2004 | Mayeu et al. |
| 2005/0230119 | A1 | 10/2005 | McGarian et al. |
| 2007/0284111 | A1* | 12/2007 | Ashy et al. ..... 166/321 |
| 2007/0285275 | A1 | 12/2007 | Purkis et al. |
| 2008/0029306 | A1 | 2/2008 | Krueger et al. |
| 2008/0093080 | A1 | 4/2008 | Palmer et al. |
| 2008/0190620 | A1 | 8/2008 | Posevina et al. |
| 2009/0025923 | A1 | 1/2009 | Patel et al. |
| 2010/0065125 | A1 | 3/2010 | Telfer |
| 2010/0252276 | A1 | 10/2010 | Clausen et al. |
| 2010/0270034 | A1 | 10/2010 | Clausen |
| 2013/0319767 | A1 | 12/2013 | Wilson et al. |

OTHER PUBLICATIONS

Australian Examination Report for Application No. 2013290166 dated Sep. 9, 2015.

* cited by examiner

MULTI-CYCLE CIRCULATING TOOL

BACKGROUND OF THE INVENTION

1. Field of the Invention

Embodiments of the present invention generally relate to a downhole circulating tool. In particular, the present invention relates to an apparatus and method for circulating fluid in a wellbore.

2. Description of the Related Art

In the drilling, completion, and production of oil and gas wells, it may be desirable to circulate fluid into the annulus of a wellbore. For example, fluid may be needed in the annulus to assist in wellbore cleanout operations, fluid may be needed in the annulus to provide additional fluid to carry drill cuttings up the annulus to the surface, or fluid may be needed in the annulus to help seal the surrounding formation. In these instances, a circulating tool may be used to provide fluid to a particular location. In addition, the circulating tool may be required to open and close multiple times.

There is a need, therefore, for a circulating tool that is reliable and able to be opened and closed multiple times.

SUMMARY OF THE INVENTION

Embodiments of the invention generally relate to an apparatus and method for circulating fluid in a wellbore. A circulating tool may include a bottom sub having a bottom sub port and a mandrel, wherein the mandrel substantially forms an inner bore of the circulating tool and includes a mandrel port. The circulating tool may also include an activation piston that is movable in a first direction and a port piston movable in a second direction when the activation piston moves in the first direction. The circulating tool may further include an inner sleeve coupled to the port piston and movable with the port piston, the inner sleeve having an inner sleeve port in selective communication with the mandrel port for controlling fluid flow through the bottom sub port.

In one embodiment, the circulating tool may include an inner portion having a bore therethrough and a first port. The circulating tool may also include a housing having a second port that is aligned with the first port. An activation piston may be disposed between the inner sleeve portion and the housing and may be actuatable in a first direction. The circulating tool may also include a port piston having a third port and configured to move in a second direction as a result of the activation piston being actuated. The circulating tool may also include an index sleeve for guiding axial movement of the port piston and the inner sleeve port, wherein when the index sleeve is in a predetermined position, the inner sleeve port is aligned with the first and second ports to allow fluid to flow out of the circulating tool.

A method for circulating fluid into a wellbore may comprise positioning a circulating tool adjacent to the wellbore, wherein the circulating tool includes a housing and a mandrel having a mandrel port. The method may also comprise supplying pressure to move an activation piston in a first direction and moving an inner sleeve in a second direction in response to moving the activation piston, wherein the inner sleeve includes an inner sleeve port. The method for circulating fluid into a wellbore may further include aligning the mandrel port and the inner sleeve port, thereby allowing fluid to flow out of the circulating tool.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1B:
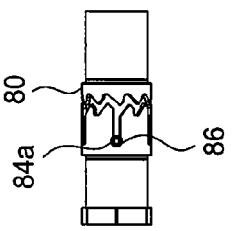
FIG. 1B is a schematic view of the profile of an index sleeve of the circulating tool of FIG. 1A, wherein the index sleeve is in a first position.
Figure 2B:
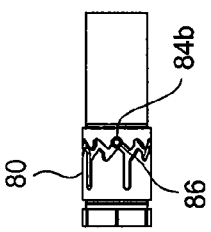
FIG. 2B is a schematic view of the profile of the index sleeve of the circulating tool of FIG. 2A, wherein the index sleeve is in a second position.
Figure 3B:
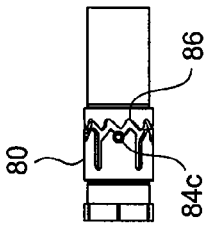
FIG. 3B is a schematic view of the profile of the index sleeve of the circulating tool of FIG. 3A, wherein the index sleeve is in a third position.
Figure 1A:
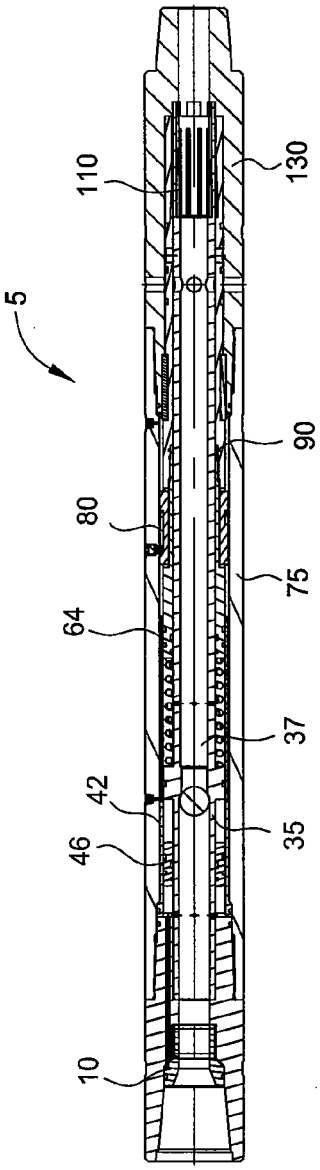
FIG. 1A is a cross sectional view of a circulating tool for circulating fluid in an annulus of a wellbore in a closed position according to an embodiment of the present invention.
Figure 2A:
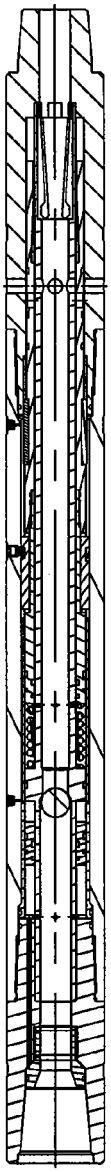
FIG. 2A is a cross sectional view of the circulating tool in an intermediate position.
Figure 3A:
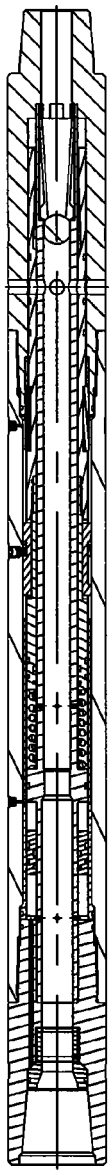
FIG. 3A is a cross sectional view of the circulating tool in an open position.

Embodiments of the present invention relate to a circulating tool for circulating fluid within a wellbore and a method for using such tool. FIG. 1A is a cross sectional view of an embodiment of the circulating tool in a closed position. FIG. 2A is a cross sectional view of the circulating tool 5 in an intermediate position. FIG. 3A is a cross sectional view of the circulating tool 5 in an open position.

In one embodiment, the circulating tool 5 may include a top sub assembly 10, a mandrel 35, an activation piston 46, a port piston 64, a housing 75, an index sleeve 80, an inner sleeve 90, a collet 110, and a bottom sub 130. The mandrel 35 is generally tubular, has a longitudinal bore formed therethrough, and substantially forms an inner bore 37 of the circulating tool 5. The mandrel 35 may be coupled to an inner portion of the top sub assembly 10 at an upper end of the circulating tool 5, and may be coupled to an inner portion of the bottom sub 130 at the lower end of the circulating tool 5. The top sub assembly 10 forms the upper end of the circulating tool 5, and is positioned above the activation piston 46. The port piston 64 is disposed below the activation piston 46 and may be, in part, surrounded by a flow sleeve 42 and the index sleeve 80. The port piston 64 may be coupled to the inner sleeve 90 at a lower end. The inner sleeve 90 is partially positioned within an inner portion of the bottom sub 130 and partially positioned within the housing 75. The collet 110 may be positioned within the bottom end of the inner sleeve 90. The housing 75 may surround and/or be coupled to exterior portions of the top sub assembly 10, the flow sleeve 42, the index sleeve 80, the inner sleeve 90 and the bottom sub 130. These components will be described more fully herein.

Figure 4:
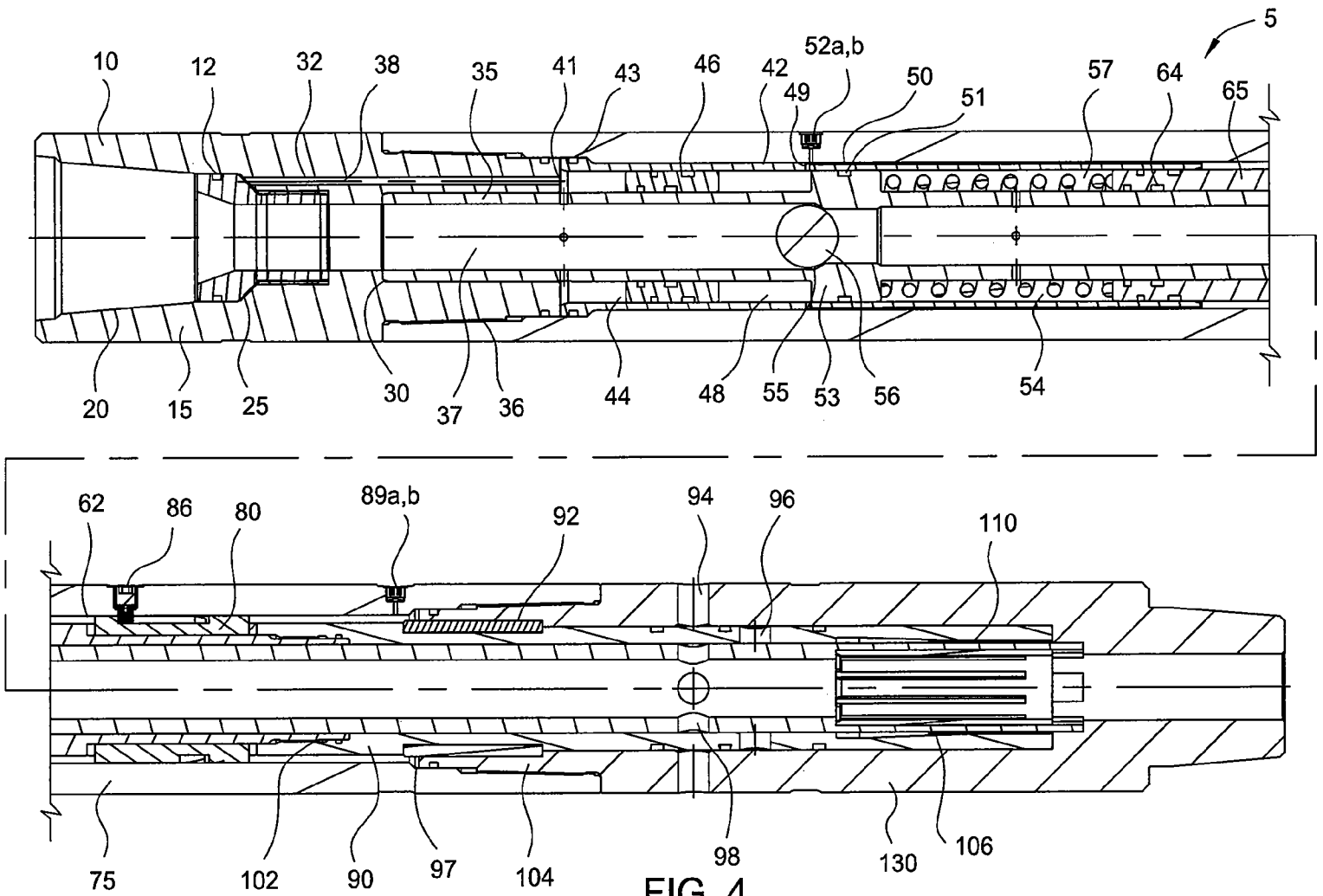
FIG. 4 is a cross sectional view of the circulating tool wherein the index sleeve is in the first position.

Turning to FIG. 4, a larger cross section view of the circulating tool 5 is shown. The top sub assembly 10, located at the top end of the circulating tool 5, may include a top sub 15, a connector 20 and a retainer 25. The connector 20 may be used to connect the circulating tool 5 to work strings or drill strings. The retainer 25 may be concentrically supported within the top sub 15, and sealing elements 12, such as o-rings, may be used to prevent fluid from leaking between the retainer 25 and top sub 15. An inner portion of the top sub 15 at a bottom end may include an optional shoulder 30 to accommodate the mandrel 35. The top sub 15 may be threaded to the housing 75. A top sub bore 32 may be positioned longitudinally within the top sub 15, and located between the retainer 25 and the bottom end of the top sub 15. The top sub bore 32 may allow a spacing rod 38 to be accepted, if necessary.

A flow sleeve 42, which is generally tubular, may surround the activation piston 46, and be concentrically surrounded and supported by the housing 75. The flow sleeve 42 may extend from the top sub assembly 10 to the port piston 64. A sealing element 43 is placed between the flow sleeve 42 and the housing 75 to prevent fluid from leaking therebetween. The mandrel 35 may be positioned to substantially form a cylinder that the activation piston 46 moves along, and may include a ball seat 55. The mandrel includes a radial extension 53 that engages the flow sleeve 42. A sealing element 51 prevents fluid from leaking between the radial extension 53 and the flow sleeve 42. The area formed between the mandrel 35, radial extension 53, flow sleeve 42, and the top sub 15 houses the activation piston 46, which floats between a first chamber 44 and second chamber 48.

In one embodiment, the ball seat 55 may be deformable. The ball seat may be elastically deformable, or the ball seat may be mechanically deformable. One mechanically deformable ball seat includes a collet seat with pins including bulbous heads that are biased in an outwardly radial direction (not shown). The collet seat may be guided axially within a collet seat housing, which moves the pins in and out of the bore. The collet seat may alternatively include a collet sleeve that may be positioned to surround the collet seat and thus contract the pins, or the collet sleeve may be moved to allow the pins to expand. The collet seat or collet sleeve movement may be guided by a piston or other actuation method. Other deformable ball seats are also contemplated. Examples of suitable deformable ball seats are disclosed in U.S. Pat. Nos. 7,441,607 and 7,661,478, both of which are incorporated by reference herein in their entirety.

One or more openings 41 placed around the circumference of the mandrel 35 allow fluid communication between the bore 37 and the first chamber 44. Drilling fluid or mud may flow into the first chamber 44 through the openings 41 and pressurize the first chamber 44 to move the activation piston 46 towards the second chamber 48.

Hydraulic fluid (not shown), such as oil, may be placed within the second chamber 48. The second chamber 48 includes a chamber port 49 that connects the second chamber 48 to a channel 50. Through the chamber port 49, the channel 50 allows fluid communication between the second chamber 48 and the port piston chamber 62. The channel 50 may be formed through the flow sleeve 42, or between the flow sleeve 42 and the housing 75. The channel 50 may run along the outside portion of the flow sleeve 42 and terminate at the piston chamber 62, where the piston chamber 62 is also filled with hydraulic fluid.

To actuate the actuation piston 46, a ball 56, which may be deformable in one embodiment, may be sent down the circulating tool 5 through the inner bore 37. The ball 56 may seat itself on the ball seat 55 and block fluid flow through the mandrel 35. When the ball 56 is seated, mud or drilling fluid flows into the first chamber 44 and builds up pressure, which in turn, causes the activation piston 46 to move in a first direction towards the lower end of the circulating tool, thereby compressing the second chamber 48. As a result, the hydraulic fluid is forced out of the second chamber 48, through the channel 50, and into the piston chamber 62.

Figure 9:
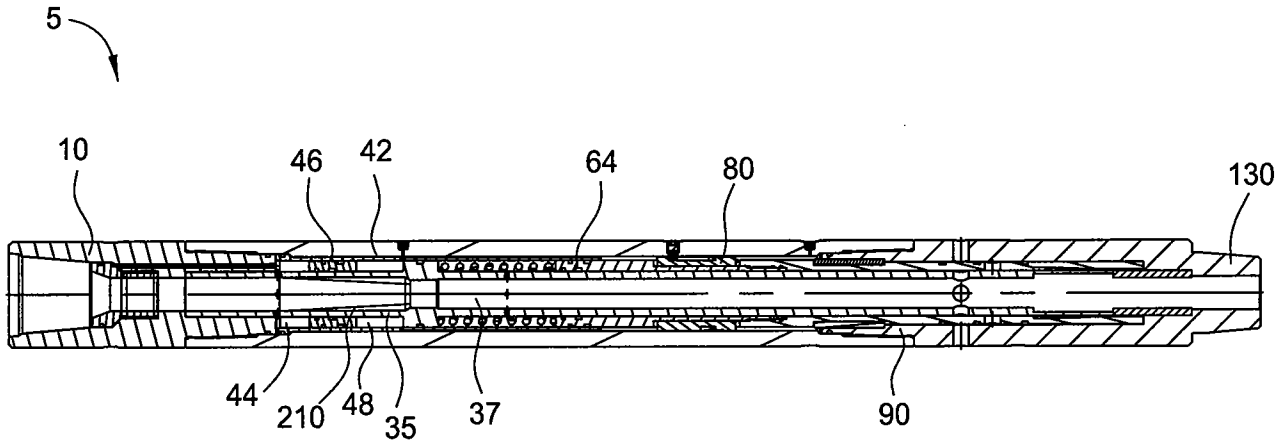
FIG. 9 is a cross sectional view of a circulating tool for circulating fluid in an annulus of a wellbore according to an embodiment of the present invention.

In one embodiment, the actuator piston 46 may be actuated by using a dart or other obturating member instead of the ball 56. In another embodiment, no ball, dart, or other obturating member needs to be used to actuate the actuator piston 46. Instead, as shown in FIG. 9, a restriction 210, such as a nozzle, may be located between the actuator piston 46 and port piston 64 at the bore 37, wherein fluid flowing at a high flow rate naturally causes pressure to build in the first chamber 44, which in turn causes the activation piston 46 to be actuated and move in the first direction.

A port 52*a* may be positioned through the housing 75 and aligned with the channel 50 to allow hydraulic fluid to be injected into or drained out of the second chamber 48 and/or channel 50. A plug 52*b* may be placed within the port 52*a* to prohibit fluid transfer between the circulating tool 5 and the annulus.

A port piston 64 is positioned between the mandrel 35 and the actuation sleeve 42. A spring 54 is located in a spring chamber 57 between the mandrel extension 53 and the upper end of the port piston 64. When the port piston 64 is actuated, which occurs when hydraulic fluid moves from the second chamber 48 to the port piston chamber 62, the port piston 64 moves in a second direction towards the top end of the circulating tool 5 and compresses the spring 54.

The upper end of the inner sleeve 90 is coupled to the port piston 64 and is movable with the port piston 64. The inner sleeve 90 may contain an inner shoulder 102 at its top end which receives and couples to the lower end of the port piston 64 via pins, or other fastening mechanism, such as a threaded connection. The port piston chamber 62 is disposed between the inner sleeve 90 and the port piston 64. An optional port 89*a* and plug 89*b* may extend through the housing 75 to fill or drain the chamber 62. Hydraulic fluid may be injected into the port 89*a* to manually actuate the port piston 64 as well, such as for testing purposes.

A guide cylinder 92 may be coupled to the outer portion of the inner sleeve 90, and may be substantially tubular. One or more longitudinal grooves are placed on the outside of the guide cylinder 92. Alignment pins 97 located in the bottom sub 130 protrude into the grooves of the cylinder 92 to ensure that the inner sleeve does not rotate relative to the circulating tool 5 as the inner sleeve 90 moves axially. When the circulating tool 5 is in its un-actuated position, the cylinder 92 may be positioned against a second shoulder 104 of the bottom sub 130. Other suitable ways of aligning the inner sleeve 90 are also contemplated.

The inner sleeve 90 also includes an inner sleeve port 96. In one embodiment, the port 96 may be the same diameter as a bottom sub port 94 located through the bottom sub 130, and the same diameter as a mandrel port 98 through the mandrel 35. The inner sleeve port 96 may be positioned on the inner sleeve 90 such that when the index sleeve 80 is in a third position 84*c* (as will be discussed herein), the inner sleeve port 96 is aligned with the mandrel port 98 and the bottom sub port 94. When these three ports 94, 96, 98 are aligned, fluid may flow out of the circulating tool 5.

Figure 7:
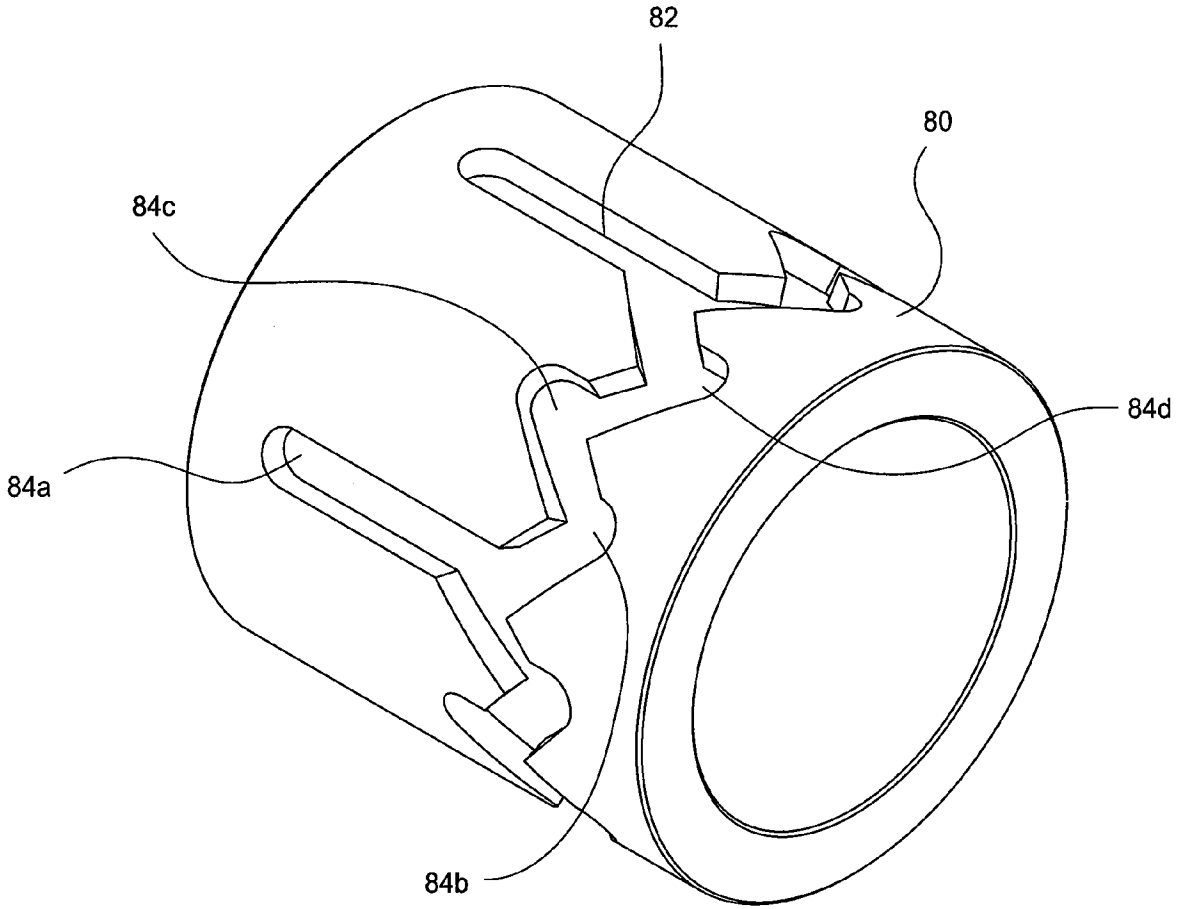
FIG. 7 is a perspective view of the index sleeve.

The index sleeve 80 may concentrically surround the port piston 64 and be located adjacent to the inner sleeve 90. The index sleeve 80, which may be cylindrical with a bore therethrough, is bounded on its exterior by the housing 75. A perspective view of the index sleeve 80 is shown in FIG. 7. The index sleeve 80 is rotatable relative to the housing 75. However, the index sleeve 80 may have limited axial movement and, as a result, may control the axial movement of the port piston 64 and the inner sleeve 90. The index sleeve 80 may contain a groove 82 around its outer circumference wherein a pin 86 may be inserted. The pin 86 may be held in a fixed position relative to the circulating tool 5 by being coupled to the housing 75. The groove 82 may have various notches that guide movement of the index sleeve 80 relative to the pin 86. For example, a first, second, third, and fourth notches 84*a-d*, respectively, may be located along the groove 82. Thus, the index sleeve 80 may have four different positions relative to its pin 86. It is contemplated that the index sleeve 80 may include additional or other alternative positions.

Figure 5:
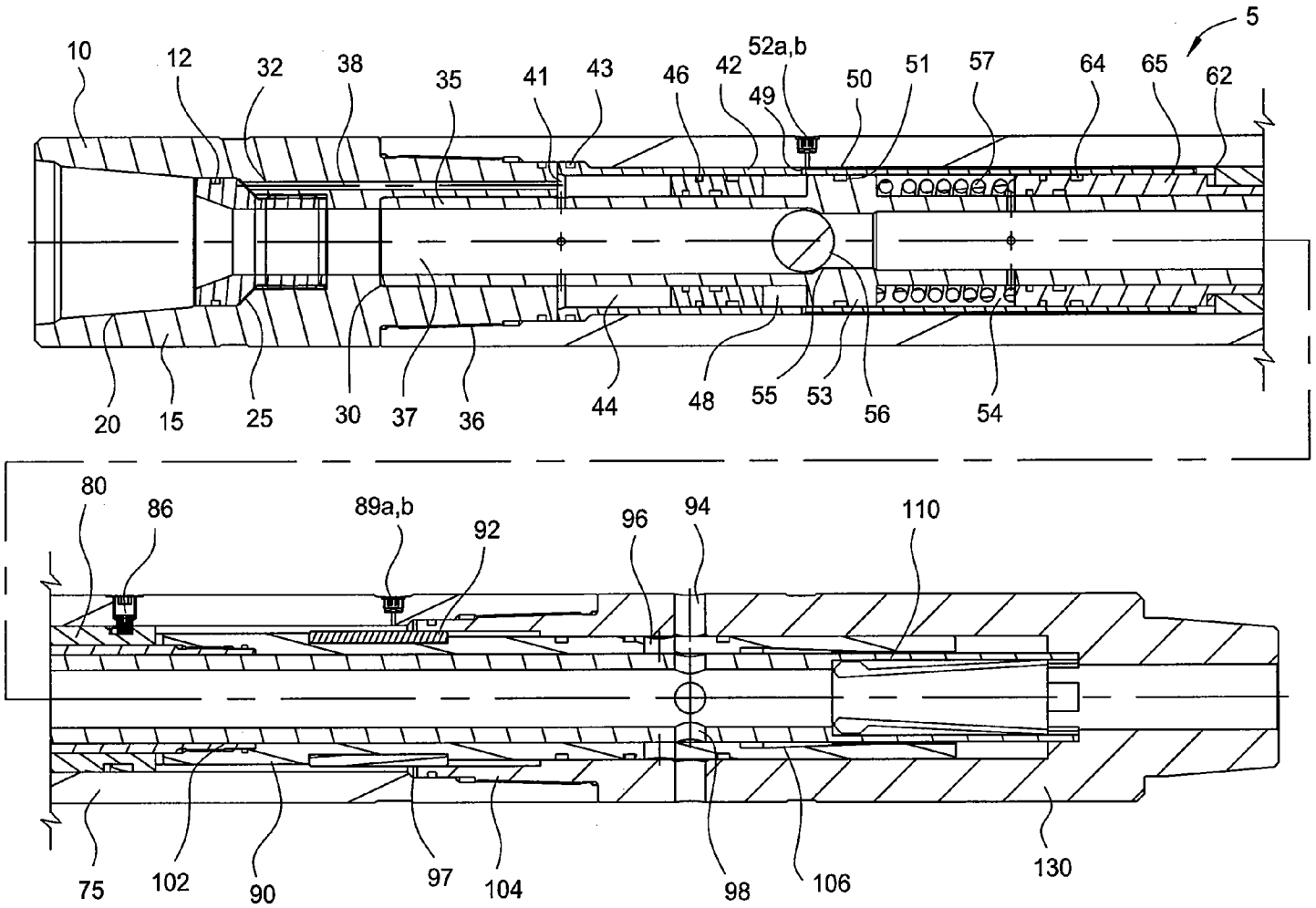
FIG. 5 is a cross sectional view of the circulating tool wherein the index sleeve is in the second position and the tool is actuated.

Before the circulating tool 5 is actuated, the pin 86 is located in the first notch 84*a* within the index sleeve 80. FIGS. 1A and 4 show a cross section of the circulating tool 5 when the index sleeve 80 is in the first notch 84*a* and FIG. 1B shows a side view of the index sleeve 80 when the circulating tool 5 is in the first notch 84*a*. After actuation of the activation piston 46 causes hydraulic fluid to flow through the channel 50 and into the port piston chamber 62, pressure builds and moves the port piston 64 in the second direction to compress the spring 54. This, in turn, causes the inner sleeve 90 to move in the second direction as well. This movement by the inner sleeve 90 pushes against the index sleeve 80 and moves the index sleeve 80 in the second direction. The pin 86 inserted in the groove 82 of the index sleeve 80 guides the index sleeve 80 into its second position 84*b*. FIG. 2A shows a cross section of the circulating tool 5 when the index sleeve 80 is in the second position 84*b* and FIG. 2B shows a side view of the index sleeve 80 when the circulating tool 5 is in the second position 84*b*. FIG. 5 shows an enlarged view of the circulating tool 5 when the index sleeve 80 is in its second position 84*b*.

In one embodiment, the bottom end of the inner sleeve 90 may include a graduated shoulder 106 for engaging collet 110. The most narrow diameter point of the graduated shoulder is positioned at the end of the inner sleeve 90, and the diameter increases along the length of the shoulder. The graduated shoulder 106 may be substantially the same length as the collet 110. The inner sleeve 90 may be at least partially positioned within the bottom sub.

Figure 8A:
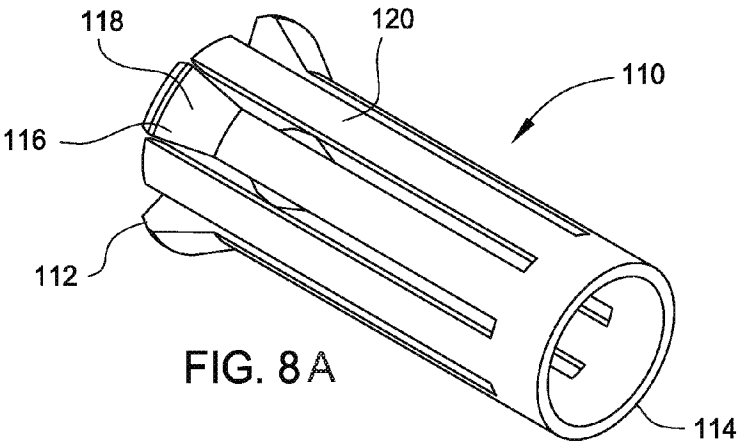
FIG. 8A is a perspective view of the collet catch.
Figure 8D:
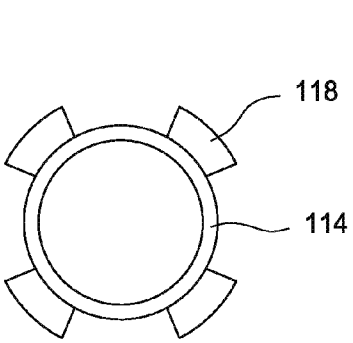
FIG. 8D is another end view of the collet catch.
Figure 8C:
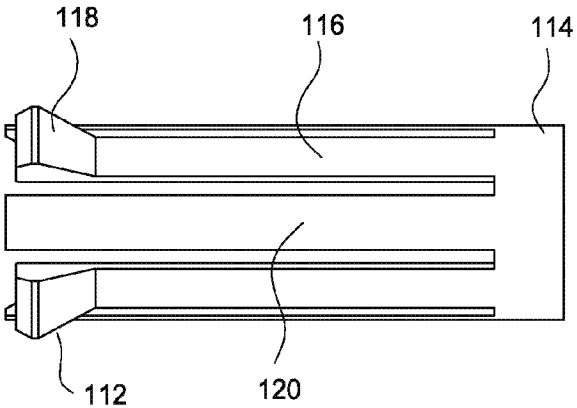
FIG. 8C is a side view of the collet catch.
Figure 8B:
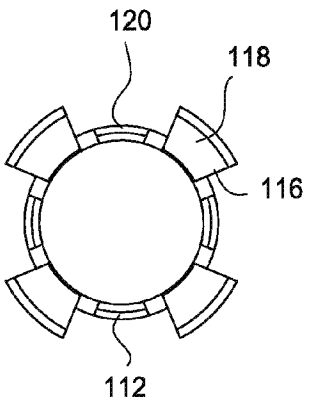
FIG. 8B is an end view of the collet catch.

The collet 110 is shown in detail in FIGS. 8A, 8B, 8C, and 8D. As shown in FIG. 8A, the collet 110 may be substantially cylindrical with a bore therethrough to allow for passage of fluid. The collet 110 may comprise bias arms 116 that are circumferentially distributed around the collet 110, and may be biased in an outwardly radial direction. As shown in FIGS. 8A and 8C, the bias arms 116 may be free on a top end 112 of the collet 110, but may be bounded or integrated into a bottom end 114 of the collet 110. The free ends of the bias arms 116 may include a head 118 that is configured to be received by the graduated shoulder 106 in the inner sleeve 90. The collet 110 may also include straight arms 120, which may be circumferentially distributed around the collet 110. The arms 120 may be biased in an outwardly radial direction and positioned within the mandrel 35. The straight arms 120 may be free from the top end 112 of the collet 110, and bounded or integrated into a bottom end 114 of the collet 110. The straight arms 120 may alternate with the bias arms 116 of the collet 110 in a radial manner (i.e., in a pattern of arm 116, straight arm 120, arm 116 . . . ). The bottom portion of the mandrel 35 may include gaps radially positioned around the mandrel 35, wherein arms 116 of a collet 110 may be received. The arms 116 of the collet 110 may extend through the gaps in the bottom end of the mandrel 35.

Figure 6:
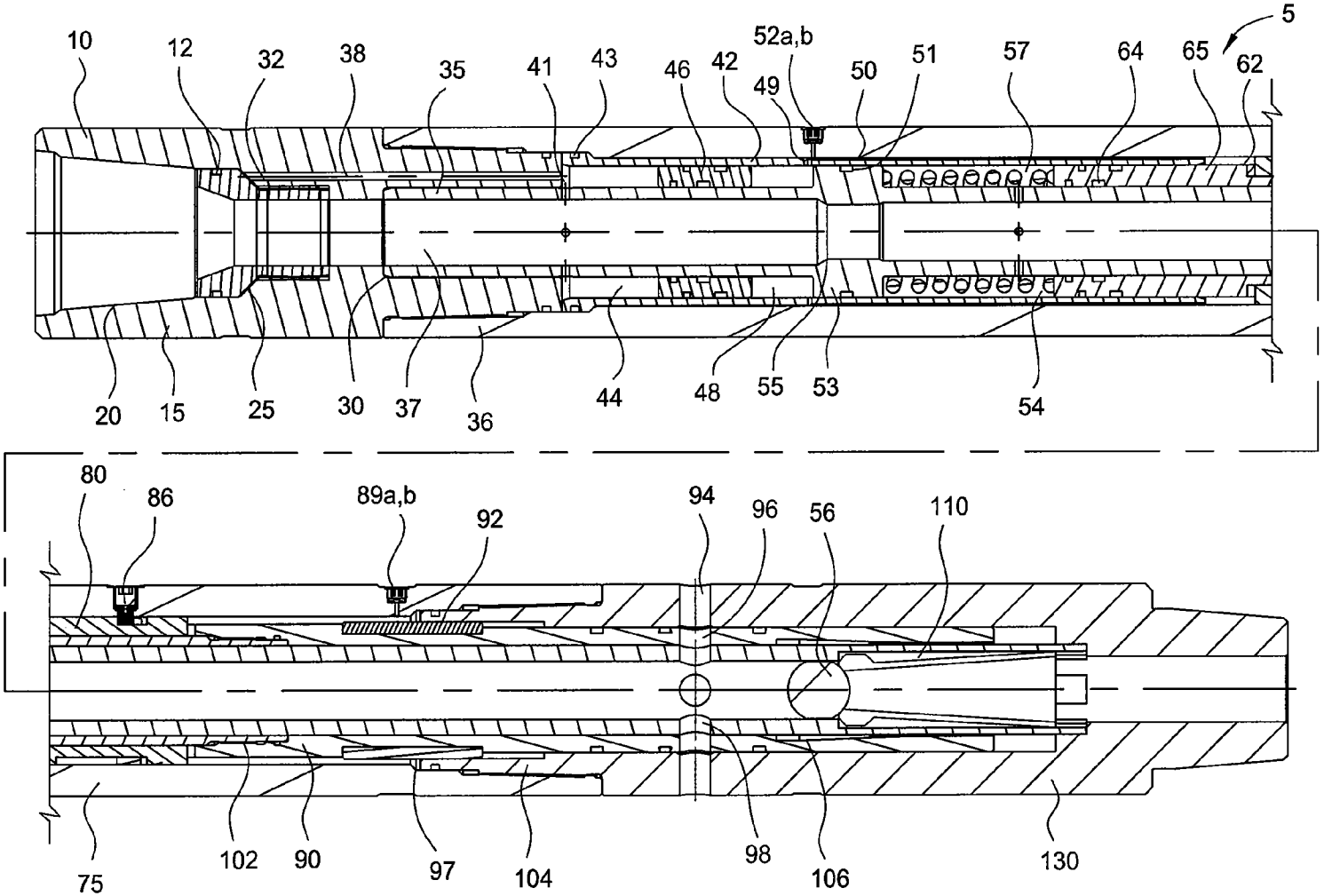
FIG. 6 is a cross sectional view of the circulating tool wherein the index sleeve is in the third position and the annulus ports are opened.

In the neutral, un-actuated position of the circulating tool 5, the collet 110 may be positioned so that the heads 118 of the arms 116 are aligned with the top end of the graduated shoulder 106 of the inner sleeve 90, where the graduated shoulder 106 is the widest. That position provides the widest diameter for fluid to pass through within the circulating tool 5. After the circulating tool 5 is actuated, the port piston 64 moves the inner sleeve 90 toward the top end of the circulating tool 5. The arms 116 of the collet 110 are compressed by the graduated shoulder 106 of the inner sleeve 90, wherein the heads 118 of the arms 116 are pushed radially through the mandrel 35 and into the bore 37 of the circulating tool 5. This arm 116 compression may be seen in FIGS. 5 and 6. The arm 116 compression forms a collet catch, wherein the ball 56 may be caught. It is contemplated that other types of ball catch devices known to a person of ordinary skill in the art may be used. Furthermore, it is contemplated that the collet 110 is an optional component of the circulating tool 5.

In operation, the circulating tool 5 may be used to circulate fluid in a wellbore. The circulating tool 5 may be actuated when the ball 56 is seated on the ball seat 55 of the mandrel 35, which causes drilling fluid to flow into the first chamber 44. Pressure build up in the first chamber 44 causes the activation piston 46 to move in the first direction towards the second chamber 48, thereby forcing hydraulic fluid through the channel 50 into the port piston chamber 62. Pressure builds within the piston chamber 62 and causes the port piston 64 to move in the second direction to compress the spring 54. Movement in the second direction causes the inner sleeve 90 to move in the second direction, which causes the index sleeve 80 to rotate as the pin 86 guides the index sleeve 80 from the first position 84*a* to the second position 84*b*. The movement of the port piston 46 and inner sleeve 90 in the second direction, also causes the arms 116 of the collet 110 to be compressed to form a collet catch (see FIGS. 2A and 5.) In the second position 84*b*, the mandrel port 98 is to the left of the bottom sub port 94, as shown in FIG. 5.

Eventually, enough pressure may build behind the ball 56 to cause the ball 56 to move past the ball seat 55 and land on the collet catch. Because the ball 56 is no longer causing pressure to build behind the activation piston 46, the pressure decreases in the first chamber 44 and in the port piston chamber 62. The spring 54 moves the port piston 64 in the first direction, which causes at least some hydraulic fluid to flow back into the second chamber 48 from the port piston chamber 62 (pressure equalization). Furthermore the inner sleeve 90 and index sleeve 80 also move in the first direction. The index sleeve 80 limits movement of these components in the first direction when the index sleeve 80 reaches the third position 84*c*, as shown in FIGS. 3A and 3B. The mandrel port 98, the inner sleeve port 96, and the bottom sub port 94 are all aligned, thereby allowing drilling fluid to flow from the drill string to the wellbore. At this point, the ball 56 remains inside the circulating tool 5. Alternatively, the index sleeve could have other positions that allow the inner sleeve port 96 to partially align with the mandrel port 98 and bottom sub port 94, wherein fluid flow from the circulating tool 5 to the wellbore could be adjusted.

To cease the drilling fluid from flowing out to the wellbore, a second ball (not shown) may be sent down the circulating tool 5. Once again, the second ball is seated at the ball seat 55. Pressure build up moves the activation piston 46 toward the second chamber 48, which forces hydraulic fluid into the port piston chamber 62. In turn, the port piston 64 moves in the second direction, which causes the index sleeve 80 to move into the fourth position 84*d*. The collet catch may still be activated when the index sleeve 80 is in the fourth position 84*d*. Pressure builds behind the second ball, and eventually causes the second ball to move past the ball seat 55. The release of the second ball causes the pressure in the first chamber 44 to decrease, which again, causes the spring to move the piston 64 in the first direction. Hydraulic fluid flows back into the second chamber 48 and urges the activation piston 46 to move in the second direction. Movement of the port piston 64 in the first direction returns the index sleeve to the first position 84*a*. When the index sleeve 80 moves back into the first position 84*a*, the inner sleeve 90 also moves in the first direction, which causes the bias arms 116 of the of the collet 110 to release both balls down the circulating tool 5. The movement of the inner sleeve 90 in the first direction also causes the inner sleeve port 96 to shift such that the bottom sub port 94, inner sleeve port 96 and mandrel port 98 are no longer in alignment, thereby ceasing the flow of drilling fluid out into the wellbore. After both balls are released from the collet 110, fluid is free to flow down the drill string once more.

Alternatively, the collet 110 may be omitted from the circulating tool 5, wherein each ball 56 is released down the circulating tool 5 after moving past the ball seat 55.

In another alternative embodiment, the use of the ball 56 and the ball seat 55 may be omitted and replaced with a restriction 210, such as a nozzle. In such embodiment, fluid is sent down the circulating tool 5 at a high flow rate, which naturally causes pressure to build in the first chamber 44 to actuate the activation piston 46.

While the foregoing is directed to embodiments of the present invention, other and further embodiments of the invention may be devised without departing from the basic scope thereof, and the scope thereof is determined by the claims that follow.

The invention claimed is:

1. A circulating tool for circulating fluid into a wellbore, the tool comprising:

a bottom sub having a bottom sub port;

a mandrel forming an inner bore of the circulating tool and includes a mandrel port;

an activation piston that is movable in a first direction;

a port piston movable in a second direction opposite the first direction in response to the activation piston moving in the first direction; and an inner sleeve coupled to the port piston and movable with the port piston, the inner sleeve having an inner sleeve port in selective communication with the mandrel port for controlling fluid flow through the bottom sub port.

2. The circulating tool of claim 1, wherein the circulating tool further comprises an index sleeve for guiding axial movement of the port piston and the inner sleeve.

3. The circulating tool of claim 2, wherein the index sleeve is movable to a position that allows the mandrel port, the inner sleeve port, and the bottom sub port to align at least in part.

4. The circulating tool of claim 2, wherein the index sleeve is movable to a position that allows the mandrel port, the inner sleeve port, and the bottom sub port to provide a fluid channel between the inner bore and the wellbore.

5. The circulating tool of claim 1, wherein the activation piston moves between a first chamber and a second chamber, and the first chamber is in fluid communication with the inner bore.

6. The circulating tool of claim 5, wherein the second chamber includes a hydraulic fluid that is in fluid communication with a port piston chamber housing the port piston.

7. The circulating tool of claim 1, further comprising a biasing member that is compressed when the port piston is moved in the second direction.

8. The circulating tool of claim 2, wherein the index sleeve comprises a groove along its outer circumference which may accept a pin, and wherein the groove is configured to guide the index sleeve to one or more positions.

9. The circulating tool of claim 8, wherein the groove provides at least four positions for the index sleeve.

10. The circulating tool of claim 1, further comprising a collet.

11. The circulating tool of claim 10, wherein the collet is adapted to form a catch when the inner sleeve is moved in the second direction.

12. A method for circulating fluid into a wellbore, comprising:

positioning a circulating tool adjacent to the wellbore, wherein the circulating tool includes:

a housing; and a mandrel having a mandrel port and disposed in the housing;

supplying pressure to move an activation piston in a first direction;

moving an inner sleeve in a second direction in response to moving the activation piston in the first direction, wherein the inner sleeve includes an inner sleeve port; and aligning the mandrel port with at least a portion of the inner sleeve port, thereby allowing fluid to flow out of the ports into the wellbore.

13. The method of claim 12, further comprising using an index sleeve to align the mandrel port and the inner sleeve port.

14. The method of claim 13, wherein the index sleeve guides axial movement of the port piston, the inner sleeve and a collet.

15. The method of claim 12, further including forming a catch with a collet when the collet is moved in the second direction.

16. The method of claim 12, further comprising compressing a spring when the port piston is moved in the second direction.

17. The method of claim 12, further including:

dropping a ball into the circulating tool; and seating the ball on a ball seat in order to supply the pressure.

18. The method of claim 12, wherein after fluid is flowing out of the ports into the wellbore, the method may be repeated to stop the fluid from flowing out of the ports.

19. A circulating tool for circulating fluid into a wellbore, the tool comprising:

an inner portion having a bore therethrough and a first port;

an outer portion having a second port that is at least partially aligned with the first port;

an activation piston disposed between the inner portion and the outer portion and actuatable in a first direction;

a port piston having a third port and configured to move in a second direction as a result of the activation piston being actuated; and an index sleeve for guiding axial movement of the port piston and the third port, wherein when the index sleeve is in a predetermined position, the third port is at least partially aligned with the first and second ports to allow fluid to flow out of the first, second, and third ports into the wellbore.

20. The circulating tool of claim 19, wherein the inner portion comprises a mandrel that includes a ball seat.

21. The circulating tool of claim 19, wherein the outer portion is comprised of an upper sub, a housing, and a bottom sub.

22. The circulating tool of claim 19, wherein the activation piston floats between a first chamber and a second chamber, and wherein the activation piston is actuated when an obturating member is seated on the ball seat, which causes drilling fluid or mud to enter into the first chamber and push the activation piston toward the second chamber.

23. The circulating tool of claim 22, wherein when the activation piston is pushed toward the second chamber, hydraulic fluid located in the second chamber is pushed into a port piston chamber to move the port piston in the second direction.

24. The circulating tool of claim 19, wherein the inner portion comprises a restriction.

25. The circulating tool of claim 24, wherein the activation piston floats between a first chamber and a second chamber, and wherein the activation piston is actuated when a fluid is sent through the restriction at a high flow rate, which causes drilling fluid or mud to enter into the first chamber and push the activation piston toward the second chamber.

* * * * *